US007185508B2

(12) United States Patent
Voglewede et al.

(10) Patent No.: US 7,185,508 B2
(45) Date of Patent: Mar. 6, 2007

(54) REFRIGERATOR WITH COMPACT ICEMAKER

(75) Inventors: Ronald L. Voglewede, St. Joseph, MI (US); Jerry M. Visin, Benton Harbor, MI (US); Douglas D. LeClear, Coloma, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 145 days.

(21) Appl. No.: 10/973,556

(22) Filed: Oct. 26, 2004

(65) Prior Publication Data

US 2006/0086134 A1 Apr. 27, 2006

(51) Int. Cl.
*F25C 5/06* (2006.01)

(52) U.S. Cl. ..... 62/353; 249/127

(58) Field of Classification Search ..... 62/351, 62/353

See application file for complete search history.

(56) References Cited

U.S. PATENT DOCUMENTS

| | | | | |
|---|---|---|---|---|
| 2,957,604 A | | 10/1960 | Goldman et al. | 221/88 |
| 3,060,700 A | | 10/1962 | De Vincent | 62/353 |
| 3,217,511 A | | 11/1965 | Keighley | 62/353 |
| 3,529,430 A | | 9/1970 | Bauerlein | 62/137 |
| 3,580,009 A | | 5/1971 | Snow | 62/353 |
| 3,677,030 A | | 7/1972 | Nicholas | 62/353 |
| 3,727,428 A | | 4/1973 | Linstromberg | 62/300 |
| 3,952,539 A | * | 4/1976 | Hanson et al. | 62/351 |
| 4,142,373 A | | 3/1979 | Weibel, Jr. et al. | 62/138 |
| 4,142,377 A | | 3/1979 | Fogt | 62/135 |
| 4,142,378 A | | 3/1979 | Bright et al. | 62/135 |
| 4,680,943 A | | 7/1987 | Mawby et al. | 62/300 |
| 5,345,783 A | * | 9/1994 | Nishikawa | 62/345 |
| 5,408,844 A | * | 4/1995 | Stokes | 62/351 |
| 5,768,900 A | * | 6/1998 | Lee, II | 62/137 |
| 5,924,301 A | * | 7/1999 | Cook | 62/347 |
| 6,112,540 A | | 9/2000 | Serrels et al. | 62/351 |
| 6,148,620 A | | 11/2000 | Kumagai et al. | 62/72 |
| 6,161,390 A | | 12/2000 | Kim | 62/72 |

* cited by examiner

*Primary Examiner*—William E. Tapolcai
(74) *Attorney, Agent, or Firm*—Robert O. Rice; John F. Colligan; Stephen Krefman

(57) ABSTRACT

A refrigerator/freezer with an ice maker having an ice cube tray in which are formed multiple ice cube recesses. The ice cube tray is movable between a fill position and a harvest position. The ice cube tray has a composite construction comprising a base layer and a top layer, with the base layer being made of a flexible material and the top layer being made of a low friction material. The ice cubes are harvested by deflecting or deforming the ice cube recesses to expel the ice cube therefrom when the tray is moved into the harvest position.

27 Claims, 9 Drawing Sheets

REFRIGERATOR WITH COMPACT ICEMAKER

BACKGROUND OF THE INVENTION

1. Field of the Invention

The invention relates to a household refrigerator having a compact icemaker. The invention also relates to the compact icemaker having a deformable ice cube tray to improve the harvesting of ice cubes.

2. Description of the Related Art

Household refrigerator/freezers are commonly sold with a compact icemaker, which is a great convenience to the consumer. Icemakers can be generally categorized into two classes based on the manner in which the ice cubes are harvested from the ice cube tray. The most common method is for the ice cubes to be formed in an ice cube tray incorporating multiple ejectors that forcibly eject the ice cubes from each of the ice cube recesses in the ice cube tray, typically from a metal mold. The other class of icemakers has ice cube trays that are inverted to expel the ice cubes from the ice cube recesses of the ice cube tray. These icemakers are usually made from a plastic material and are generally referred to as flextrays.

In the metal mold class of icemakers, it is common to use a resistance wire formed in the ice cube tray to heat the ice cube tray to melt the ice cubes at their interface with the ice cube tray thereby enhancing the likelihood that the ice cubes can be successfully harvested from the ice cube tray.

In the flextray version icemaker, generally a rotational force is applied to the mold to impart a stress by flexing the tray to generate enough pressure on the cube to forcibly remove the cubes from the mold. A heating element is generally not used with the flextray. The elimination of the heater makes the icemaker more energy efficient. Along with the energy efficiency, the resistance wire approaches are undesirable due to their cyclic temperature loading of the freezer compartment. The higher temperature swings of the freezer result in increased occurrences and severity of freezer burn as well as an increase in sugar migration within products. The sugar migration specifically shows up in ice cream products and is highly undesirable.

Even with devices such as the ejectors and heaters to aid in the harvesting of the ice cubes, it is still a common problem for the ice cubes to be stuck in the tray, which is highly undesirable. A stuck ice cube can result in an over-fill condition for the ice cube tray since the ice cube tray is typically filled with a predetermined charge of water based on the total volume of the ice cube recesses. In an over-fill condition, the excess water will spread across the multiple ice cube recesses and upon its freezing form a layer of ice connecting the individual ice cubes, which further increases the likelihood that the ice cubes will not be harvested.

If the icemaker has a mechanism for detecting such an over fill condition, the icemaker is shut down until the stuck ice is removed, resulting in a loss of ice production for the consumer. If the icemaker does not have an over fill detection mechanism, the icemaker will continue to introduce water into the ice cube tray, which will eventually flow into the freezer to form a large block of ice, which is a great inconvenience to the consumer, especially if the ice forms on items contained within the freezer.

In the flextray icemaker, the system repeatedly stresses the mold to a high level to guarantee ice cube release. This cyclic high stress has a degrading effect on the plastic and causes failure of cubes to release or even worse a breakage of the mold. Without proper cube release an overfill event will occur. With a breakage of the mold an even worse case of continuous water flow into the product can occur until it is sensed or the consumer intervenes.

It is still desirable to have an icemaker capable of reliably producing and harvesting ice cubes.

SUMMARY OF THE INVENTION

The invention relates to an automatic ice maker comprising a housing in which an ice cube tray is moveably mounted for movement between a fill and a harvest position. The ice cube tray comprises multiple ice cube recesses for receiving and holding water to form an ice cube. Each ice cube recess has a flexible portion to permit the flexing of the flexible portion to aid in the removal of an ice cube formed therein. A low friction coating is applied to the upper surface of each ice cube recess to further help in the removal of the ice cube.

The ice maker also has a harvest mechanism for moving the ice cube tray from the fill to the harvest position and deforming the resilient portion of each ice cube recess as the ice cube tray is moved from the fill position to the harvest position to aid in removing the ice cube in the ice cube recess.

The ice cube tray is preferably elongated and defines a rotational axis about which the ice cube tray is rotated to move the ice cube tray from the fill to the harvest position.

The harvest mechanism can have a reversible electric motor for rotating the ice cube tray between the fill and harvest positions. The harvest mechanism can also include a deflector that the ice cube recesses contact in the harvest position to deflect the ice cube recesses and expel the ice cubes therein.

The reversible electric motor is preferably a self-reversing electric motor that automatically reverses direction to return the ice cube tray to the fill position in response to the self-reversing electric motor stalling when the rotation of the ice cube tray is stopped by contact with the deflector or any other type of stop.

The ice cube tray can comprise a removeably mounted insert and the ice cube recesses are formed in the insert. Multiple inserts can be provided and the user can select one of the inserts to mount to the ice cube tray. Each insert preferably has a set of ice cube recesses and the selection or shape of ice cube recesses is different for each set.

The insert preferably comprises a composite structure of a flexible base layer and a low friction layer, which forms the low friction coating. The flexible base layer can be made of plastic or metal. The plastic is preferably polyurethane and silicone.

The metal can also be electrically conductive while having sufficient resistance such that when a current is passed through the insert it will heat an amount sufficient to release an ice cube contained within an ice cube recess when the tray is in the harvest position.

The low friction layer can be made from any suitable low-friction material and is preferably made from flouropolymer, teflon, or parylenes.

The insert can have a peripheral rim that surrounds the ice cube recesses and bounds a volume at least equal to twice the sum of the volume of the ice cube recesses to retain a double fill of the ice cube tray.

In another aspect, the invention also relates to an automatic icemaker for a household freezer wherein the icemaker comprises a housing for mounting to the interior of a household freezer. A composite ice cube tray having multiple ice cube recesses and comprising a resilient base layer and a low friction layer on top of the base layer, with the low friction layer forming the upper surface of the ice cube recesses. A harvest mechanism moveably supporting the composite ice cube tray for movement between a fill position where liquid can be introduced into the ice cube recesses to make ice cubes and a harvest position where the composite ice cube tray is deformed to aid in removal of ice cubes in the ice cube recesses.

DESCRIPTION OF A PREFERRED EMBODIMENT

Figure 1:
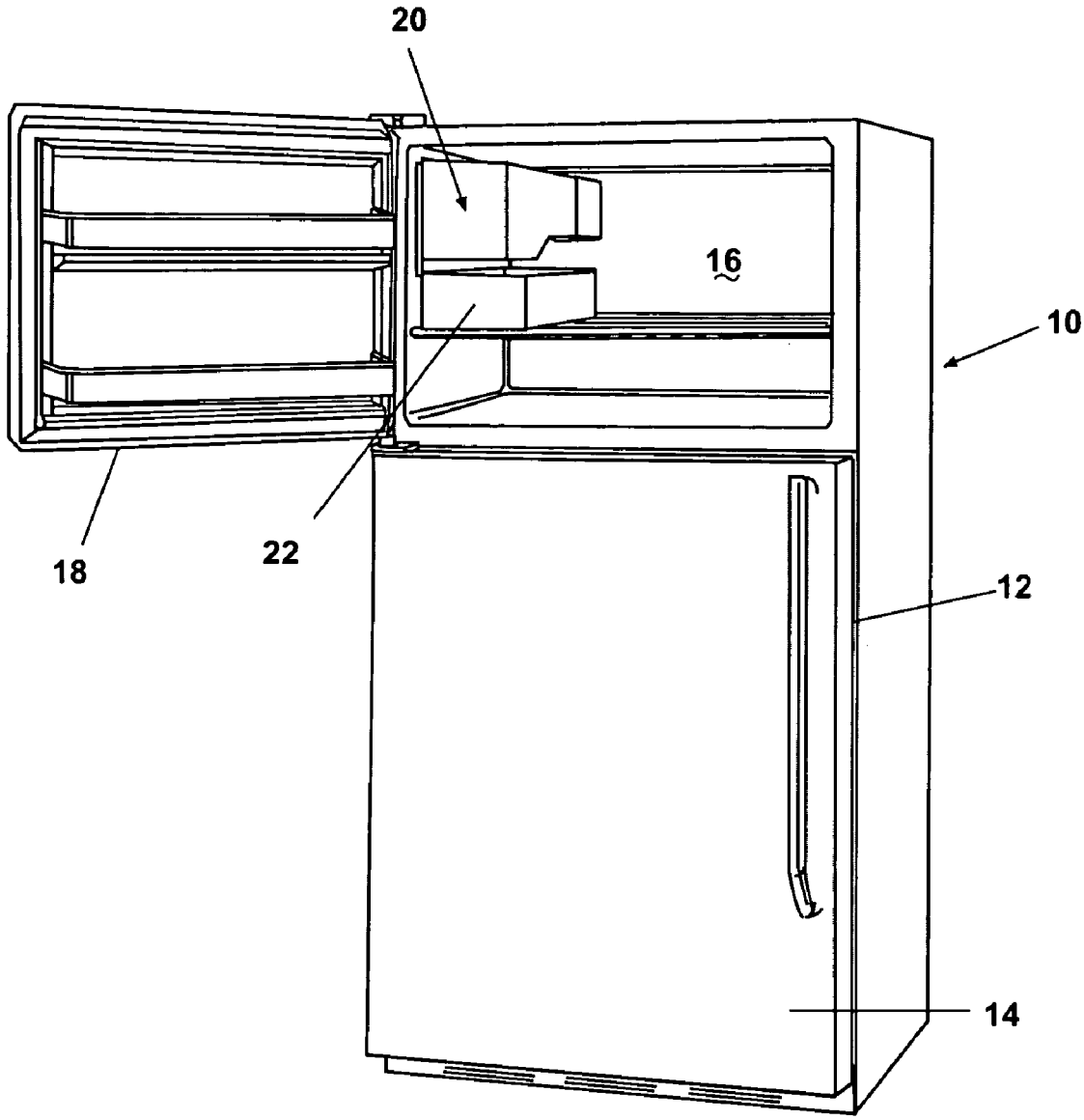
FIG. 1 is a perspective view of a household refrigerator/freezer, with the freezer door shown in an open position and illustrating an icemaker in accordance with the invention.

FIG. 1 illustrates a household refrigerator/freezer 10 comprising a refrigeration compartment 12, which is closed by a door 14, and a freezer compartment 16, which is closed by a door 18. An ice maker 20 is located within the freezer compartment 16, preferably by mounting the ice maker 20 to one or more of the walls (not numbered) forming the freezer compartment 16. An ice cube bin 22 rests on a bottom wall of the freezer compartment 16 and is located beneath the ice maker 20 to collect ice cubes harvested from the ice maker 20.

Figure 2:
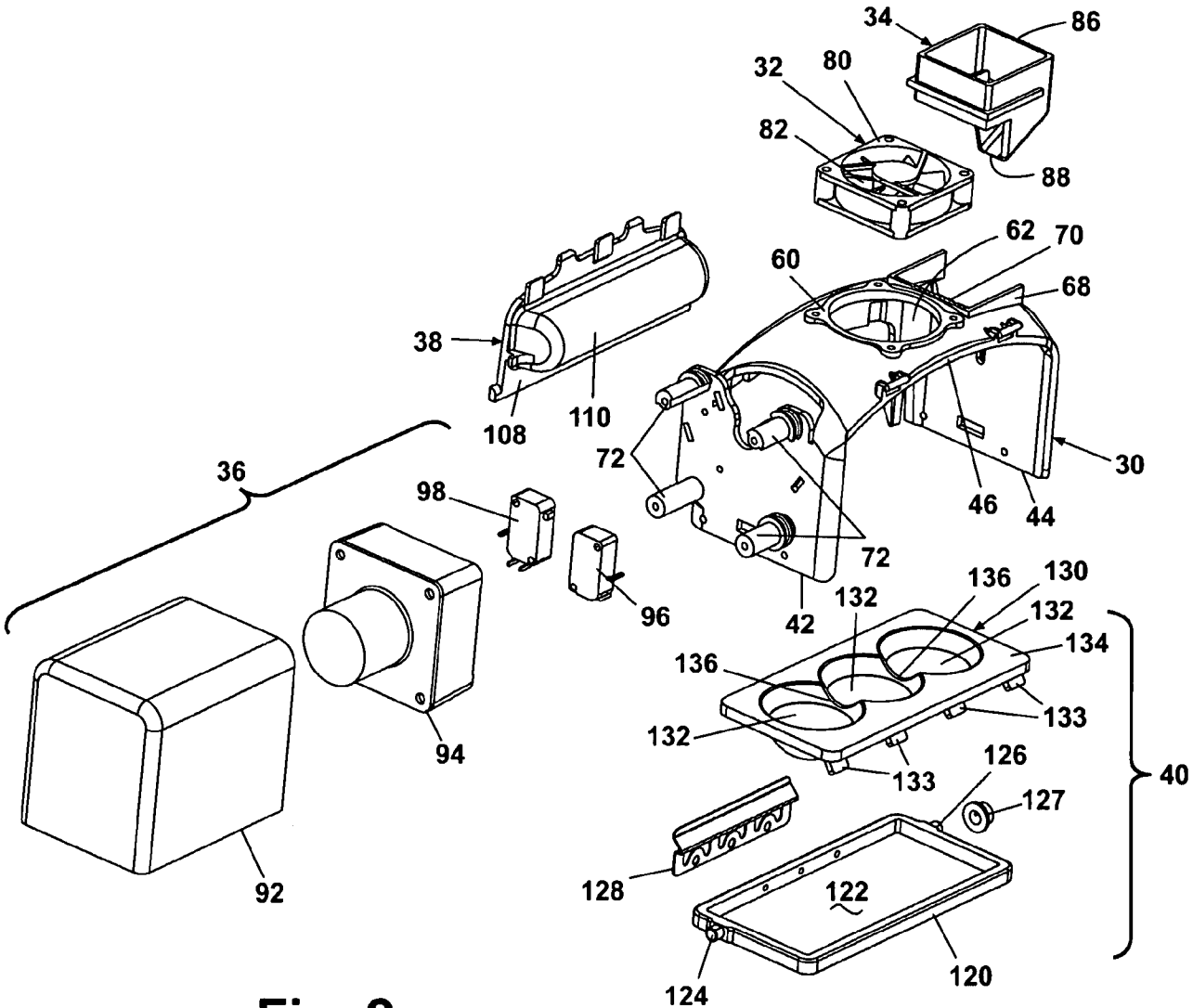
FIG. 2 is an exploded view of the icemaker of FIG. 1 and shows the icemaker housing to which is rotatably mounted an ice cube tray, which is driven by an electric motor assembly between a fill position, where liquid is introduced into the ice cube tray, and a harvest position, where ice cubes are removed from the ice cube tray.

FIG. 2 illustrates the components comprising the ice maker 20, which includes a main housing 30 that supports all other elements of the ice maker 20, including a fan 32, water inlet 34, drive assembly 36, deflector 38, and ice cube tray 40. The main housing 30 mounts to the walls forming the freezer compartment 16 to thereby mount all elements of the ice maker 20 to the freezer compartment 16.

Figure 4:
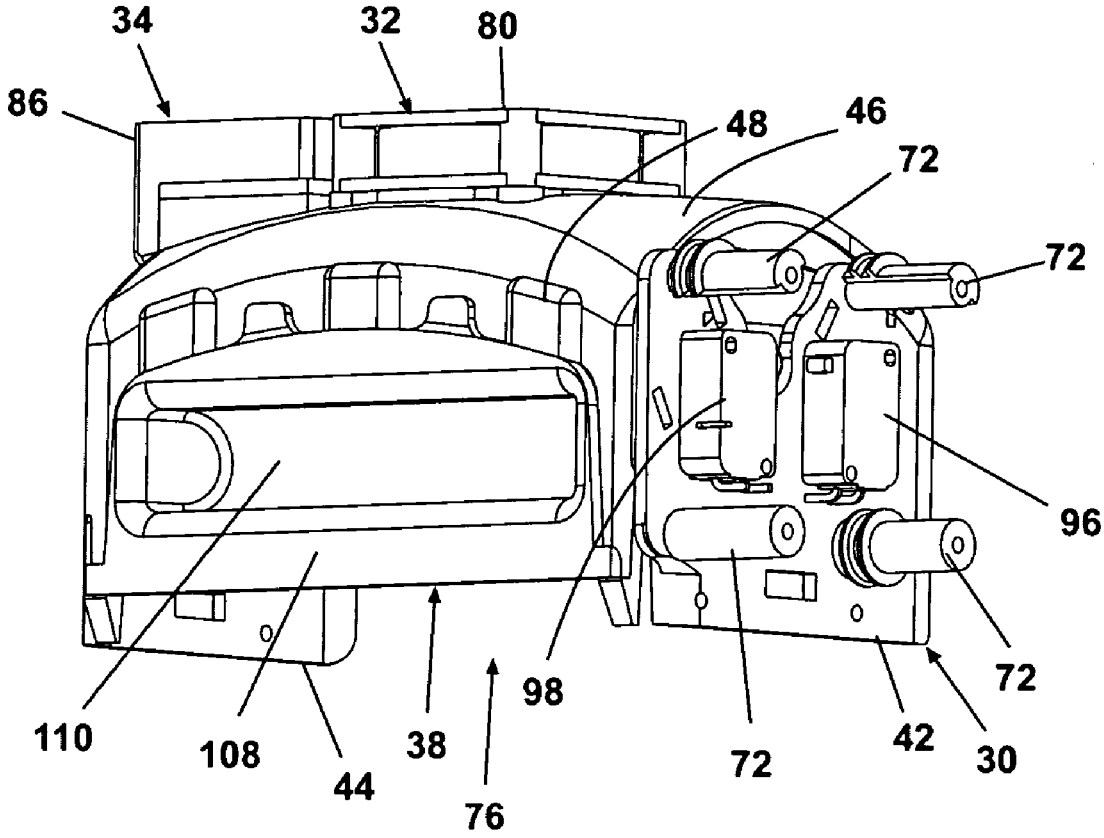
FIG. 4 is a rear perspective view of the icemaker shown in FIG. 3 and illustrating the deflection bar for deflecting the ice cube tray to expel the ice cubes therefrom when the ice cube tray is in the harvest position.

The main housing 30 comprises opposing end walls 42, 44, whose upper edges are interconnected by an arched top wall 46. A partial rear wall 48 (FIG. 4) extends between the top wall 46 and the end walls 42, 44 at the rear edges thereof.

The top wall 46 includes a fan mount 60 to which the fan 32 is mounted. The fan mount 60 defines a fan opening 62, permitting air from the fan 32 to be directed onto the ice cube tray 40. The top wall 46 further includes an inlet mount 68 to which the water inlet 34 is mounted. The inlet mount 68 defines an opening 70 through which liquid can be introduced into the ice cube tray. The end wall 42 includes a series of mounting posts 72, which are used to mount a portion of the drive assembly 36 to the main housing 30.

Figure 3:
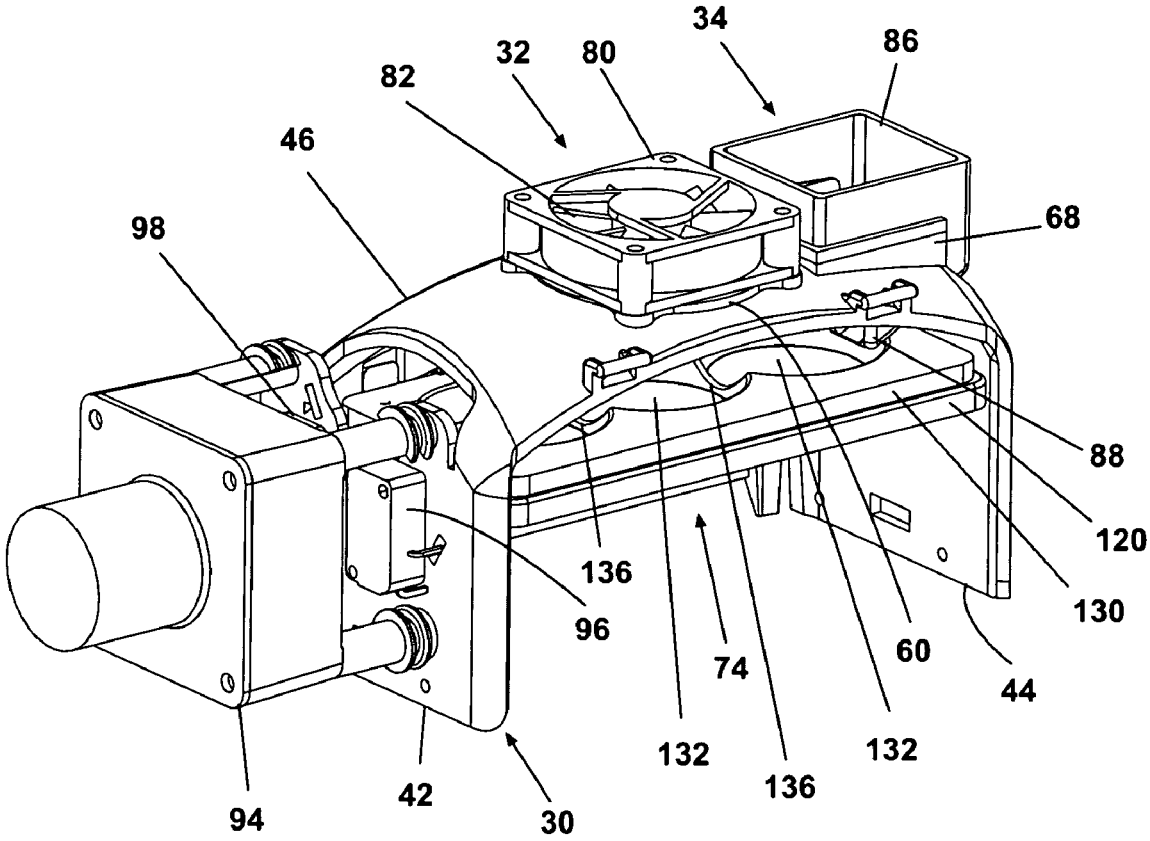
FIG. 3 is a front perspective view of the icemaker shown in FIGS. 1 and 2, with the cover for the electric motor assembly removed for clarity.

The top wall 46 in combination with the end walls 42, 44 define an open face 74 (FIG. 3), which provides access to the ice cube tray 40. Similarly, the rear wall 48 in combination with the end walls 42, 44 define an open bottom 76 (FIG. 4) in the main housing 30.

The fan 32 comprises a fan housing 80 in which is mounted a fan blade 82 and electrical motor (not shown). The fan housing 80 is mounted to the fan mount 60 such that the fan blade 82 directs air onto the ice cube tray 40.

The water inlet 34 includes an open-top well 86 having a spout 88, extending from the bottom of the well 86. The well 86 is mounted to the inlet mount 68 such that the spout 88 extends through the opening 70; and is positioned above the ice cube tray 40, such that any liquid introduced into the well 86 will flow out the spout 88 and onto the ice cube tray 40.

The drive assembly 36 comprises a cover 92 that overlies an electric motor 94, which is mounted to the posts 72, such that there is a space between the electric motor 94 and the end wall 42. Limit switches 96, 98 are mounted to the end wall 42 in the space between the end wall and the electric motor 94. Each of the limit switches 96, 98 has a trip arm 100, 102. The limit switches 96, 98 are positioned on the end wall 42 such that they are actuated when the ice cube tray is in the fill and harvest positions, respectively. In this manner, the position of the ice cube tray 40 can be detected by the limit switches 96, 98. Other switches or sensors, such as reed switches or hall effect sensors, could be used to detect the position of the ice cube tray 40.

The cover 92 is provided for the drive assembly 36 and covers the electric motor 94 and limit switches 96, 98 when the cover is mounted to the main housing 30. The cover is provided for aesthetic purposes since the drive assembly 36 faces the open front of the freezer compartment 16 when the icemaker 20 is mounted to the freezer compartment 16.

The deflector 38 comprises an elongated base 108, which is mounted to the partial rear wall 48 in the end walls 42, 44. The base 108 effectively closes off the open area in the main housing 30 below the partial rear wall 48. A projection or rib 110 extends from the base 108 and into the interior of the main housing 30. The rib 110 is used to deform the ice cube tray 40 when the ice cube tray 40 is in the harvest position to aid in expelling the ice cubes therefrom.

The ice cube tray 40 comprises a frame 120 defining a central opening 122. Pins 124, 126 extend from sides of the frame 120 and are received within corresponding openings in the end walls 42, 44 of the main housing 30 to rotatably mount the frame 120 with respect to the main housing 30. A cap 127 is provided to snap onto one of the pins to fix the frame 120 to the housing 30. Preferably, the pins 124, 126 are located laterally of the longitudinal centerline for the frame 120. The pin 124 is adapted to couple with the electric motor 94 such that the actuation of the electric motor 94 will rotate the frame 120 about the axis extending through the pins 124, 126.

A spring clip 128 is mounted to the side of the frame 120 opposite the open face of the main housing 30. The spring clip 128 defines a recess 129 (FIG. 55 that lies above the frame 120.

The ice cube tray 40 further comprises a mold insert 130 comprising multiple ice cube recesses 132, which are surrounded by a planar portion 134. The planar portion 134 defines the outer periphery of the insert 130. The insert 130 includes downwardly extending fingers 133 located on the edge of the insert 130 nearest the open face of the main housing 30.

The fingers 133 and spring clip 128 are used to removeably mount the insert 130 to the frame 120. To removeably mount the insert 130, the insert 130 is positioned within the frame such that the fingers 133 bear against the inner surface of the side of the frame 120 adjacent the open face of the main housing 130 thereby forming a rotation interface between the frame 120 and the fingers 133. The insert 130 is further rotated about the interface until the opposing side of the insert 130 is snapped into the recess 129 on the spring clip 128, causing a temporary deflection of the spring clip as the insert 130 bears against the spring upon continued rotation. When the insert 130 is mounted to the frame 120, ice cube recesses 132 are received within the central opening 122 of the frame 120 and the planar portion 134 overlies the frame 120.

A removable mounting of the insert 130 to the frame 120 provides the functionality that a particular user can have multiple and/or different inserts 130 and interchange them as desired. For example, for special occasions, such as Valentine's Day, an insert with ice cube recesses in the shape of hearts could be used to form heart-shaped ice cubes. Another example would include having pumpkin or ghost shaped ice cube recesses for use at Halloween. A particular insert can have ice cube recesses of the same shape or different shapes. The shape of the ice cube recesses and selection of particular recesses on a particular insert are limitless.

In the preferred embodiment, the ice cube recesses 132 have a hemispherical shape and are arranged in a side-by-side relationship. An arcuate over-fill spillway 136 fluidly connects adjacent ice cube recesses 132. The lowermost portion of the spillway 136 preferably defines the liquid fill level under normal circumstances. That is, as the ice cube recesses 132 are filled with liquid, any filling all of an ice cube recess 132 beyond the lowermost portion of the spillway 136 will result in the liquid flowing into the adjacent ice cube recess 132. With this construction, all of the ice cube recesses 132 can be filled by introducing water into only one of the ice cube recesses 132 and relying on the flow through the spillway 136 to adjacent ice cube recesses to sequentially fill all of the ice cube recesses 132.

As is seen in the drawings, the sidewalls of the ice cube recesses 132 extend a substantial distance above the lowermost portion of the spillway 136. Preferably, the volume of the ice cube recess 132 above the lowermost portion of the spillway 136 is equal to the volume of the ice cube recess below the lowermost portion of the spillway 136. With such a configuration, the insert 130 can accommodate a double-filling of the ice cube recesses 132 with liquid. A double-filling can occur when the ice cubes retained within the ice cube recesses 132 are not properly harvested and remain in the insert 130 during the next filling operation.

The continuous portion of the insert 134 by the portion of the ice cube recesses 132 above the lowermost portion of the spillway 136 can be thought of as a peripheral wall surrounding or bounding the ice cube recesses 132. The peripheral wall is used to retain extra liquid beyond the single charge of liquid needed to properly fill the portion of the ice cube recesses 132 below the lowermost portion 136 of the spillway.

Figure 5:
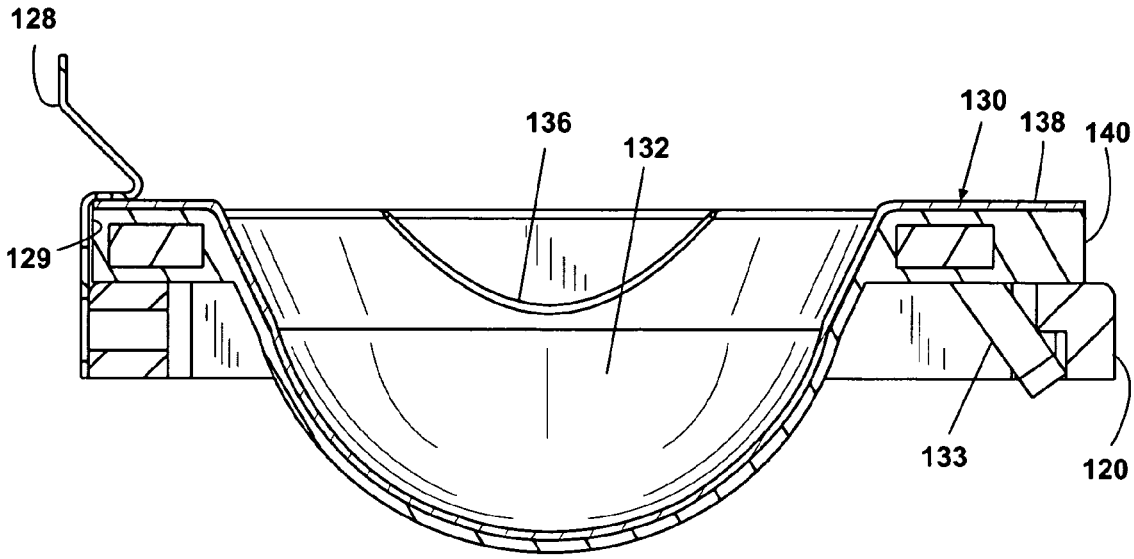
FIG. 5 is a transverse sectional view of the ice cube tray taken along lines 5—5 of FIG. 2.

Referring to FIG. 5, the construction of the insert 130 is shown. Preferably, the insert 130 has a composite construction comprising a base layer 140 and a top layer 138. The top layer 138 is disposed on the base layer 140. The top layer 138 forms the upper surface of the insert 130.

The base layer 140 is preferably made of a resilient or flexible material, which can be deformed while still returning to its original shape after deformation. This is especially important for the portion of the base layer 140 in which the ice cube recesses 132 are formed. It is not as important for the planar portion 134 surrounding the ice cube recesses 132. A suitable resilient or flexible material can include any appropriate plastic. Examples of suitable plastics would include polyurethane and silicone. Examples of suitable materials also include metals capable of being deflected and returning to its original shape after deflection. Such metals would most likely be thin, at least at the portions forming the bottoms of the ice cube recesses 132. Suitable metals include: steel, aluminum, and magnesium.

One advantage of using a flexible metal over a flexible plastic to form the base layer 140 is that, if the metal is electrically conductive, a current can be applied to the metal base layer 140 to melt an ice cube at the interface between the ice cube and the ice cube recess 132 thereby enhancing the likelihood that the ice cube will be removed from the tray when harvested. Thus, the metal base layer can form a heater and not require a special resistive heating element as used in prior ice makers.

The top layer 138 is preferably a low friction material that reduces the likelihood that an ice cube formed in the ice cube recesses 132 will mechanically or molecularly remain attached to the insert 130 and prevent the harvesting of the ice cube. Suitable plastics include flouropolymer, teflon, and parylenes. The plastic is preferably coated onto the base layer 140 to form the top layer 138.

Figure 6:
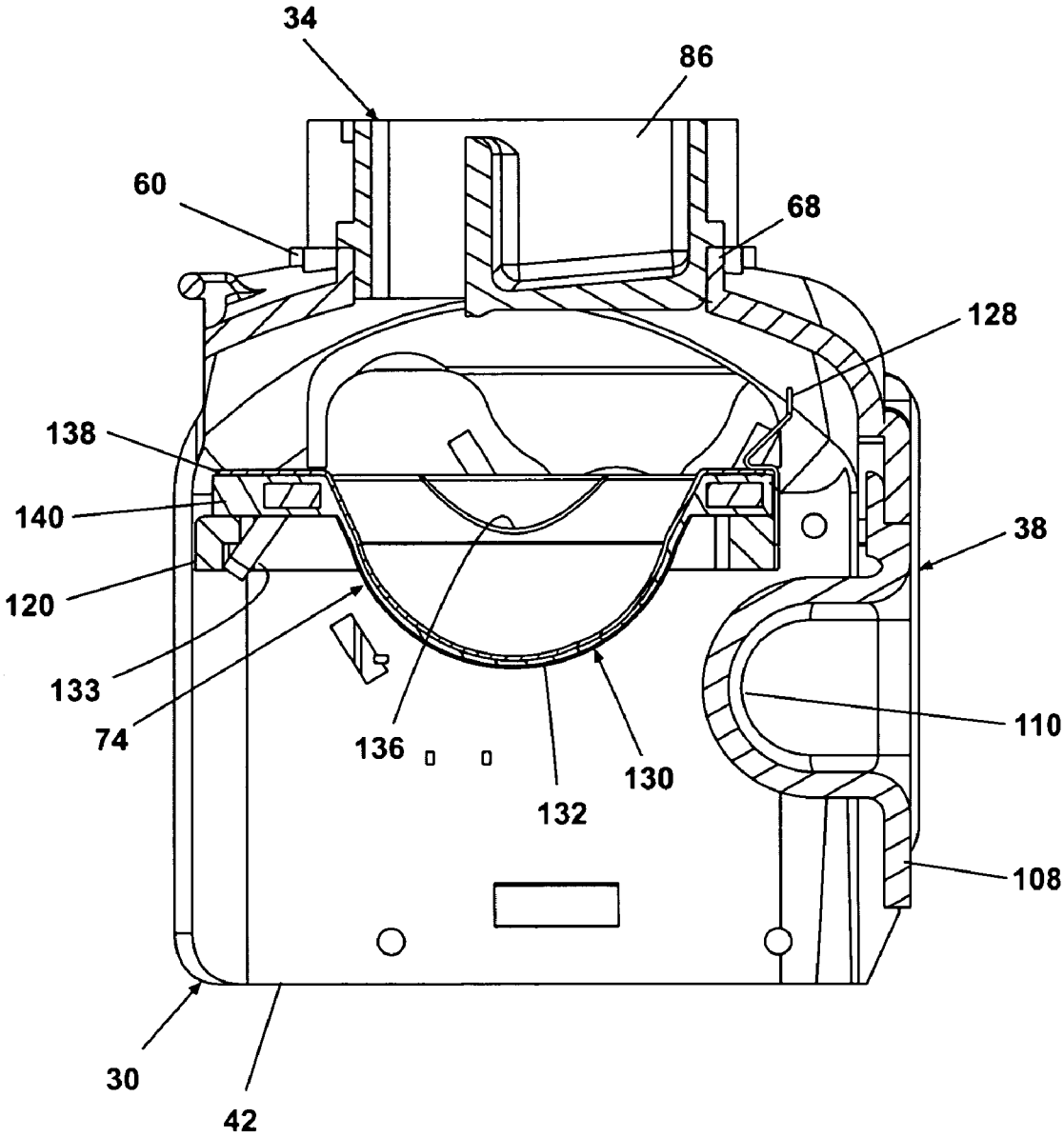
FIG. 6 is a side-sectional view of the icemaker and illustrating the ice cube tray in the fill position.
Figure 7:
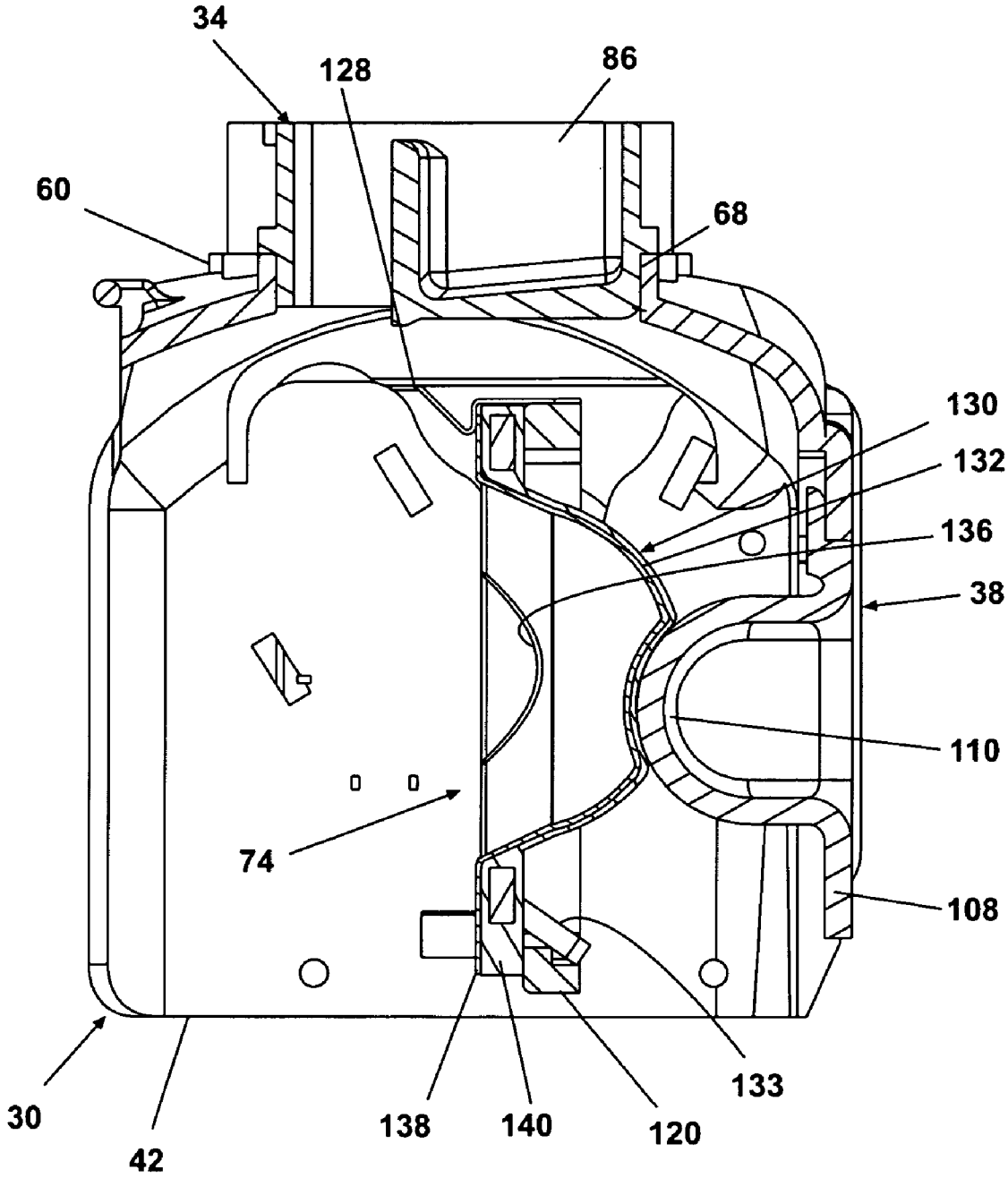
FIG. 7 is a side-sectional view identical to FIG. 6, except that the ice cube tray is shown in the harvest position.

Referring to FIGS. 6 and 7, the operation of the ice maker 20 will be described for one complete ice-making cycle beginning with the filling of the ice cube recesses 132 with liquid and ending with the harvesting of the resulting ice cubes. As the ice cube recesses 132 are filled with liquid, which in most cases will be water, the ice cube tray 40 is in the fill position as seen in FIG. 6. Water is introduced into the ice cube recesses 132 through the spout 88 of the water inlet 34. In particular, the spout 88 directs water into the ice cube recess 132 that is positioned directly below the spout 88. Once the water level in this ice cube recess 132 reaches the lowermost portion of the spillway 136, the continued introduction of water from the water inlet 34 will result in the filling of the adjacent ice cube recess 132 as the water flows over the spillway 136. The ice cube recesses 132 are sequentially filled in this manner.

After the ice cube recesses 132 have been filled with water, the ice cube tray 40 is maintained in the fill position until the water is frozen to form the ice cube. Once the water has frozen to make the ice cubes, the electric motor 94 of the drive assembly 36 is actuated to move the ice cube tray 40 from the fill position in FIG. 6 to the harvest position in FIG. 7. As the ice cube tray 40 nears the harvest position, the bottoms of the ice cube recesses 132 make contact with the rib 110 of the deflector 38. Further rotation of the ice cube tray 40 to the harvest position results in the bottoms of the ice cube recesses 132 being deflected inwardly relative to the ice cube recesses 132 and thereby expelling the ice cubes from the ice cube recesses 132. The ice cubes then fall into the ice cube bin 22.

As the ice cube tray 40 reaches the harvest position, further rotation of the ice cube tray is prevented by the rib 110. Alternatively, a separate stop extending from the housing and contacting the frame in the harvest position can function to stop the ice cube tray at the harvest position and prevent over rotation. The electric motor 94 of the drive assembly 36 is then reversed and returns the ice cube tray 40 to the fill position to complete the ice making cycle.

The reversal of the electric motor can be accomplished in different ways. One way is for the ice cube tray 40 to contact a trip arm 100 of the limit switch 96 to effect the switching of the direction of the electric motor 94. This method requires the extra limit switch along with a more complex control and is not preferred. The preferred way to reverse the electric motor 94 is to use a non-directional AC timer motor, which automatically reverses direction when the electric motor 94 stalls in response to the ice cube tray 40 contacting the rib 110 or some other stop, which stops the rotation of the ice cube tray 40. This method does not require active control by a controller.

As the ice cube tray 40 returns to the fill position, the ice cube tray 40 contacts the trip arm 102 of the other limit switch 98. The electric motor is then turned off by the controller.

If the ice maker is to use a heater to melt the ice cubes at the interface with the ice cube tray, it is preferred that the base layer 140 be made of metal as previously described to reduce the complexity of the ice maker. Current would be sent to the metal base layer 140 a sufficient time to ensure melting at the interface prior to the ice cube tray reaching the harvest position.

It is contemplated that the ice maker 20 will have a suitable controller, preferably in the form of a microprocessor, to which the fan 32, electric motor 94, and limit switches 96, 98 are coupled. The controller would control the actuation and timing of the various components of the icemaker to effect the steps of the ice cube making process. The controller would also control the water supply to the water inlet. Typically, the refrigerator/freezer has a water supply with a solenoid-type valve for controlling the introduction of water to the water inlet.

Figure 8:
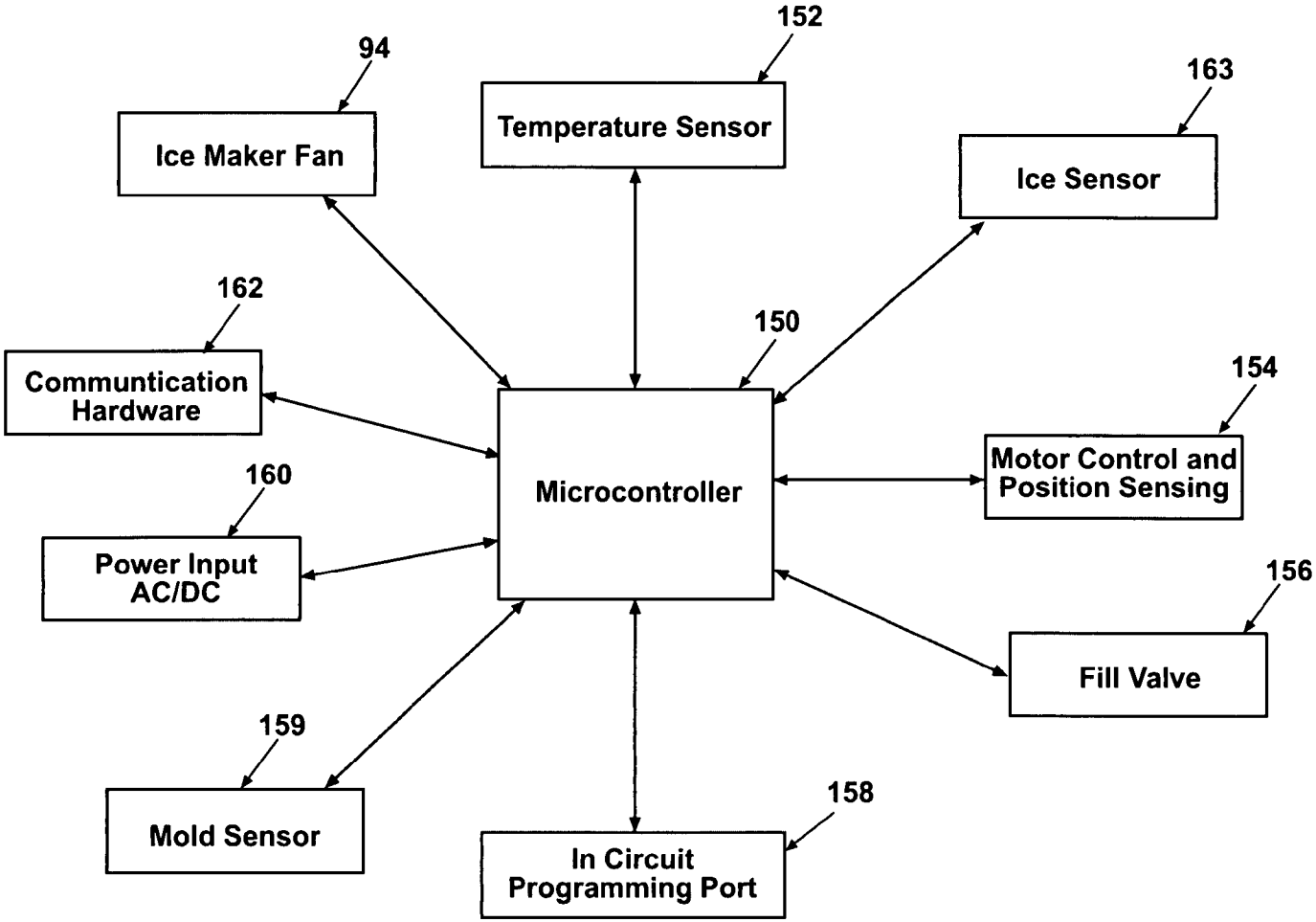
FIG. 8 is a schematic representation of a microcontroller-based ice-making system for performing a control algorithm for controlling the making of ice cubes with the icemaker.
Figure 9:
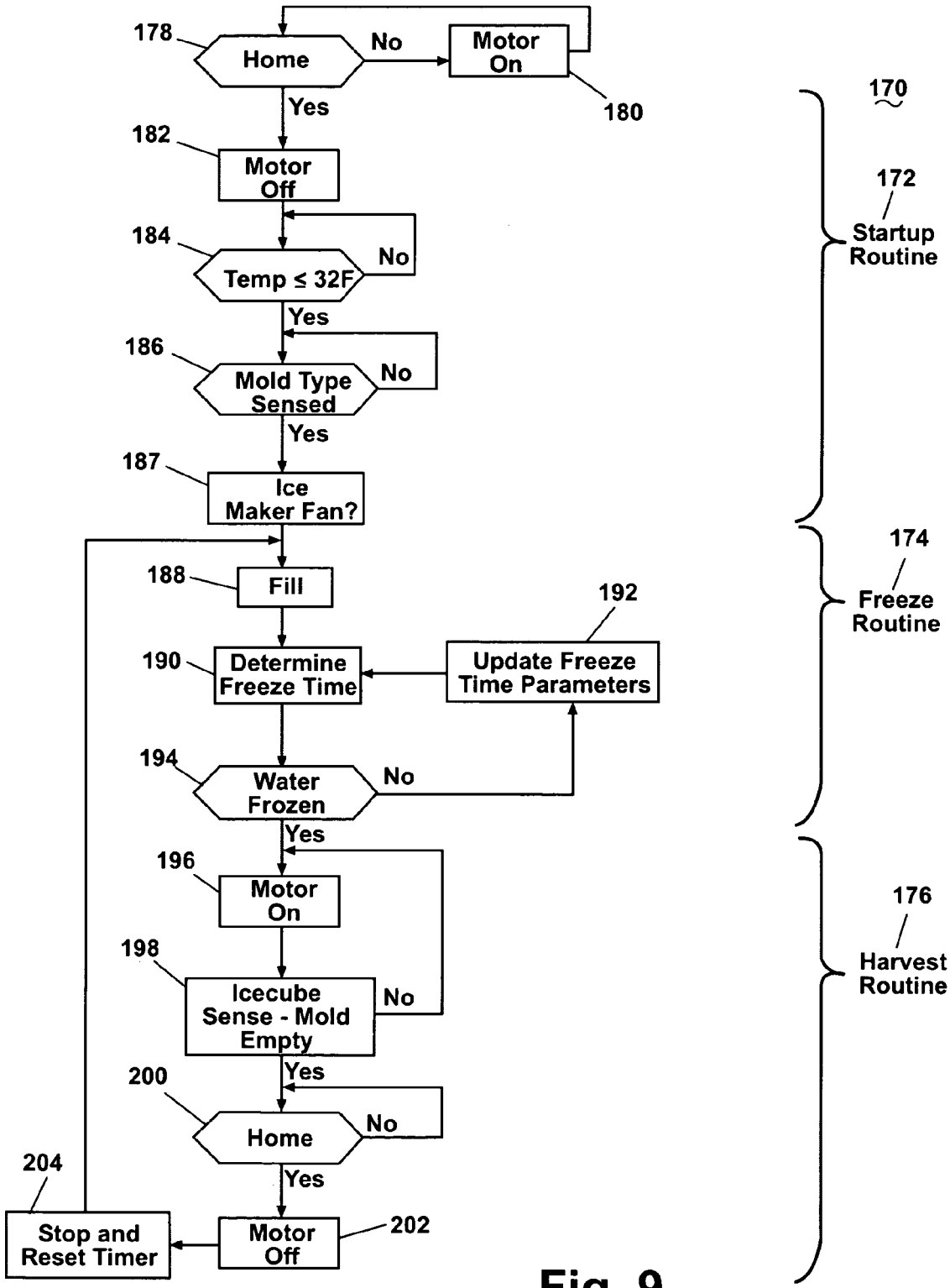
FIG. 9 is a flowchart of an algorithm for controlling the making of ice cubes with the icemaker.

FIG. 8 illustrates a schematic of a preferred controller in the form of a microprocessor-based ice making control system that can be utilized to control the making of ice with the herein-described ice maker 20. The microprocessor 150 comprises a suitable well-known digital processor and is programmed with an electronic timed-based control process 170 that is illustrated in FIG. 9. The microprocessor 150 is interfaced with selected operational components needed to make ice. A temperature sensor 152 is provided for sensing the temperature of the ice maker 20 and to send a corresponding signal to the microprocessor 150. Preferably, the temperature sensor 152 is located such that it senses the temperature of the air just above the ice cube tray 40. Alternatively, the temperature sensor can be a thermistor in contact with the tray 40 and which sends a known signal to the microprocessor 150. The signal is typically proportional to the sensed temperature.

A motor controller and position sensor 154 is provided for determining the position of the ice cube tray 40 and adjusting the position for filling and harvesting. The previously described limit switches 96, 98 can perform the position sensing function and the motor 94 can effect the movement of the ice cube tray 40.

A fill valve 156 is provided for controlling the delivery of water to the tray 40 of the ice maker 20. The fill valve 156 is well known in the art and is coupled to a water supply to the refrigerator. Preferably, the fill valve is a solenoid valve.

A programming port 158 is provided for programming modifications that must be made to the microprocessor 150. The programming port 158 provides a mechanism whereby the control method 170 can be updated.

A mold sensor 159 is provided for sensing the type of mold insert 130 inserted within the frame 120. The mold sensor can be any suitable type of sensor. For example, each mold insert 130 can have a unique set of electrical contacts that couple with a set of master contacts located on the frame 120 and coupled to the microcontroller 150. These contacts would work like the DX Camera Auto Sensing Code used in 35 mm cameras for sensing the film type and film speed based on the circuit printed on the film canister. Electrical contacts would be printed on the mold inserts 130 and the probes would be mounted on the frame and connected to the microprocessor 150.

A power input 160 is provided for supplying power to the microprocessor 150. The power input 160 is preferably any suitable DC supply.

Communication hardware 162 provides an interface for communicating between other components of the refrigerator and the microprocessor 150. For example, in most contemporary refrigerators a main processor (not shown) is used to control the overall operation of the refrigerator. The primary function of the main processor is to control the cooling cycle to keep the refrigerated compartment and the freezer compartment at the selected temperatures by controlling the operation of the compressor and corresponding evaporator fan in a single evaporator configuration or multiple fans in a dual evaporator configuration to circulate chilled air through the compartments. The communication hardware 162 establishes communication between the main processor and the microprocessor 150 for the ice maker to permit the transfer of data and instructions therebetween. For example, the status and operating parameters of the compressor and fans can be sent to the microprocessor 150 as can the number and duration of door openings for freezer compartment. A serial communication system could be used for the communication hardware 162.

An ice sensor 163 is provided for sensing whether the ice cubes have been harvested. Any of the many well known ice sensors can be used. The sensors can check for the presence or absence of ice in the mold insert 130 or the presence or absence of additional ice in an ice storage bin. Examples of suitable ice sensors include a bail arm that is normally raised and lowered from and into an ice cube storage bin with each harvest. If the ice cubes have been harvested, the bail arm will not lower as far as it did prior to harvest, indicating the presence of new ice cubes in the storage bin. Optical or sonic sensors can be used to detect the presence/absence of additional ice cubes in the storage bin or the mold insert 130. The resistance/conductance of the mold insert 130 can be sensed. Any of these and other known techniques can be used. Such a sensor would be connected to the microcontroller 150.

The control algorithm 170 can be segregated into three routines: a Startup Routine 172, a Freeze Routine 174, and a Harvest Routine 176. The Startup Routine 172 is initiated after any type of power shutoff be it intended (the appliance is being moved to a new location) or unintended (loss of power to the home). The Startup Routine 172 begins with a home position testing step 178 in which the ice cube tray 40 is moved to the home or fill position ready to receive water for making ice cubes. Ensuring that the ice cube tray 40 is in the home position ensures that the fill water will enter the ice cube tray and not be sprayed into the freezer compartment. Whether the ice cube tray 40 is in the home position can be determined by the limit switches 96, 98 or other suitable sensors. If the ice cube tray 40 is not in the home position, the motor 94 is turned on (or kept on if the motor is already on) in step 180 to further rotate the ice cube tray toward the home position. Control then returns to the home position testing step 178 to check again whether the ice cube tray 40 is in the home position. This process is repeated until the ice cube tray 40 is in the home position.

Once the ice cube tray is in the home position as determined in step 178, the motor is shut off in step 182 to leave the ice cube tray 40 in the home position. The Startup Routine 172 then checks the temperature of the freezer compartment to ensure that the temperature of the freezer compartment 16 is less than or equal to 32° F. If it is not, temperature monitoring is repeated until the temperature is determined to be below 32° F. In essence a temperature wait state is created where the process will not continue until the freezer compartment is below freezing. This ensures that the freezer compartment is capable of making ice before any water is introduced to the ice cube tray.

In the next step, the ice mold insert 130 type is first sensed at 186. As described above, different mold inserts 130 can be incorporated into the ice cube tray 40. Different mold inserts 130 can have different mold volumes, which require different fill volumes of water which must be controlled. Preferably, the microprocessor 150 will have data stored for each of the anticipated types of trays. The volume of water can also be used as a parameter for the Freeze Routine 174. If the mold insert 130 is not sensed, the step 186 is repeated until the mold insert 130 is sensed. If no mold insert 130 is sensed, it is presumed that no mold insert 130 is present and the Startup Routine will not continue.

After the ice mold insert 130 is sensed, the presence of the dedicated ice maker fan 94 is sensed at step 187. While the ice maker fan 94 is optional, it is preferred because the dedicated fan positioned above the ice cube tray 40 will shorten the time it takes for the water in the ice cube tray 40 to freeze because air flowing over the top of the water results in the water freezing more quickly. Without the dedicated fan 94, the general air circulation created by the evaporator fan(s) or similar fans are the only other means for circulating air within the freezer compartment. However, this generally circulated air is often blocked from directly reaching and blowing across the ice cube tray 40 because of the general air flow path into the freezer compartment or objects (food items and the ice maker) in the freezer compartment. The dedicated ice maker fan 94 ensures that air will flow across the top of the ice cube tray 40. The presence of the ice maker fan 94 is preferably determined by the electrical coupling of the fan 94 to the microprocessor 150. The coupling of the ice maker fan will set a flag in the microprocessor 150 indicating the presence of the fan 94. The check for the presence of the fan 94 completes the Startup Routine 172.

Once the Startup Routine is completed, control passes to the Freeze Routine 174. The first step of the Freeze Routine is to fill the ice cube tray 40, which is sitting in the home position. The ice cube tray is filled by the microcontroller 150 turning on the fill valve 156 to introduce water into the water inlet 34 where it is directed into the ice cube tray 40. While the microcontroller 150 could directly monitor the volume of water dispensed from fill valve 156, it is preferred and more simple if the microcontroller 150 keeps the fill valve 156 on/open for a predetermined amount of time based on the sensed mold insert 130. Since the water pressure supplied to the fill valve 156 is usually within a predetermined pressure range, the dispensed volume can be approximated by the amount of time the valve 156 is open.

Once the mold insert 130 is filled 188, the microcontroller 150 initiates the determination of a Freeze Time at step 190. The Freeze Time is the time it takes for the water to freeze from the filling of the mold insert. In step 194, the water is checked to see if it is frozen by the microcontroller 150 keeping a timer corresponding to the time that has passed since the filling of the mold insert. If the timer exceeds the determined Freeze Time, it is presumed that the water is frozen. If the Freeze Time is not exceeded, then the parameter(s) used to calculate the Freeze Time are updated at 192 and controls passes to step 190 where a new Freeze Time is determined. If the parameters have not changed since the last Freeze Time determination, the updated Freeze Time will equal the prior Freeze Time.

The microcontroller 150 can use one or more parameters to determine when the water is frozen depending the desired precision for the water freezing. All things being equal, greater precision is desired since it will maximize the ice cube production over time, which is very beneficial to the consumer. However, greater precision normally increases complexity of the Freeze Routine and the Freeze Time determination and the corresponding hardware. At the simplest level, the microcontroller 150 can use the time since filling as the only parameter for determining when the water is frozen. The Freeze Time selected by the microcontroller 150 can be a time that is great enough to ensure that the ice will freeze for any of the anticipated inserts.

At a more precise level, the time selected can be associated with the sensed mold insert 130. The microcontroller 150 can store a data value corresponding to an optimized time for water to freeze in each mold insert 130. While the optimized freeze time for each mold insert 130 is more precise than a single freeze time for all the inserts, the insert specific freeze time is still based on certain assumptions about the temperature of the freezing compartment over time. The mold insert 130 specific freeze time is often longer than needed to ensure that the water is completely frozen and thereby prevent the harvesting of water into the ice cube bin, which would cause all of the cubes to freeze together as a solid block, which is highly undesirable.

To further increase the precision of determining the time for when the water freezes, the microcontroller 150 monitors the data from the temperature sensor 152, which is preferably located to sense the temperature of the air passing over the mold insert 130. The temperature of the air passing over the mold insert 130 will sharply decrease once the water is frozen. The microcontroller 150 monitors the output of the temperature sensor 152 looking for the drop in temperature associated with the freezing of the water.

Other parameters can also be used to add further precision to the Freeze Routine. For example, the number of on/off cycles of either or both of the compressor and evaporator fan can be used to refine the freeze time. The number of on/off cycles of the compressor since the filling of the ice cube tray is an indication of the amount of cooling applied to the air in the freezer compartment. All things being equal, the greater the amount of cooling applied to the freezer compartment, the faster the water will freeze. The number of on/off cycles of the evaporator fan is an indication of the amount of time that air has circulated within the freezer compartment. All things being equal, the greater the air circulation, the faster the water freezes. Another parameter that can be used is the number of times that the freezer door is opened since the fill. All things being equal, the more times the freezer door is opened, the longer it will take the water to freeze.

The number of freezer door openings and the number of on/off cycles are the types of parameters that are supplied to the microcontroller 150 through the communication hardware 162 since the values for these parameters are normally tracked by the controller for the refrigerator and not the micro controller 150.

Other parameters can be employed to set the Freeze Time. The freezer compartment ambient air temperature is one additional parameter. The tray temperature is another, which can be determined by using a bimetal/thermistor to directly measure the mold temperature. The time from last defrost is yet another parameter. These parameters can be used in various combinations to create a more precise and adaptive control.

Once the Freeze Routine 174 determines that the water has frozen by the Freeze Time being exceeded in step 194, then control passes to the Harvest Routine 176 for harvesting the ice cubes. The Harvest Routine begins by turning on the motor 94 at step 196 to move the ice cube tray from the fill to the harvest position. The status of the harvested ice cubes is sensed in step 198 by the microcontroller 150 using the output of the ice sensor 165. If the ice cubes have not been harvested, then control passes back to the motor on step 196 to continue the movement of the ice cube tray. Alternatively, the motor on step 196 can comprises moving the ice cube tray 40 from the fill to the harvest position and back to the fill position, with the sensing of the ice cubes taking place after the return to the fill position. Thus, if ice is sensed in the ice cube tray 40, the ice cube tray 40 is moved through the fill/harvest/fill cycle to try and harvest the ice cubes. This cycle can be repeated until all of the ice cubes are harvested. It is important that all of the ice cubes be harvested. If they are not, then the next water fill might overflow the mold insert 130 and spill within the freezer compartment, where the water, if not cleaned up, can freeze, which is a great annoyance to the consumer.

Once the ice cubes have been completely harvested, control passes to a Home position step 200 where it is determined if the ice cube tray 40 has been returned to the home position for initiation of another ice cube making cycle. If it has not been returned to the home position, the motor continues to run until it is in the home position. When the tray 40 has returned to the home position, the motor is turned off 202. The timer is stopped and reset 204, and control passes back to the Freeze Routine to repeat the process.

The controls could be adapted to also correct errors, such as double filling of the tray, low heater wattage, and unremovable ice cubes. The controls would accomplish this by employing an algorithm to time the harvest cycle. If the tray returned to the home position early, the tray heater would be cycled on again, and another attempt to harvest would be made. This could be repeated two or three times, followed by pulsing of a fault signal light. An alternative option would be to completely melt the unremoved ice cubes, run through another ice making cycle, and then attempt to self-correct the problem.

The invention is advantageous over the prior art in that it provides a household refrigerator/freezer with an ice maker that is highly effective in creating and harvesting ice cubes with little possibility that the ice cubes will not be properly harvested. The physical deformation of the ice cube recesses in combination with the low friction coating greatly increases the likelihood that all of the ice cubes will be expelled from the ice cube tray during harvesting.

The invention is further advantageous in that it does not require complex controls, especially when an automatic reversing motor is used.

While the invention has been specifically described in connection with certain specific embodiments thereof, it is to be understood that this is by way of illustration and not of limitation, and the scope of the appended claims should be construed as broadly as the prior art will permit.

One notable variation is the portion of the ice cube tray that is flexible or resilient. Given the hemispherical shapes of the preferred ice cube recesses, it is desirable from a manufacturing standpoint to have the entire ice cube recess be deflectable. However, it is within the scope of the invention for only a portion of the ice cube recess to be resilient or deflectable to ensure that contact with the deflector will break the connection between the ice cube and the ice cube tray and expel the ice cube.

The invention claimed is:

1. An automatic ice maker, comprising:

a housing;

an ice cube tray moveably mounted to the housing for movement between a fill and a harvest position and defining multiple ice cube recesses having open tops and closed bottoms—for receiving and holding water to form an ice cube therein, and each ice cube recess having an upper and lower surface;

each ice cube recess having a flexible portion made from a resilient material to permit the flexing of the flexible portion to aid in the removal of an ice cube formed therein;

a low friction coating applied to the upper surface of each ice cube recess; and a harvest mechanism moving the ice cube tray from the fill to the harvest position and deforming the resilient portion of each ice cube recess as the ice cube tray is moved from the fill position to the harvest position to aid in removing the ice cube in the ice cube recess.

2. The automatic ice maker according to claim 1, wherein the ice cube tray is elongated and defines a longitudinal axis about which the ice cube tray is rotated to move the ice cube tray from the fill to the harvest position.

3. The automatic ice maker according to claim 2, wherein the harvest mechanism comprises a reversible electric motor for rotating the ice cube tray between the fill and harvest positions.

4. The automatic ice maker according to claim 3, wherein the harvest mechanism comprises a rotation stop that prevents the ice cube tray from rotating beyond the harvest position.

5. The automatic ice maker according to claim 4, wherein the reversible electric motor is a self-reversing electric motor that automatically reverses direction to return the ice cube tray to the fill position in response to the self-reversing electric motor stalling when the rotation of the ice cube tray is stopped by the rotation stop.

6. The automatic ice maker according to claim 1, wherein the ice cube tray comprises a removeably mounted insert and the ice cube recesses are formed in the insert.

7. The automatic ice maker according to claim 6, and further comprising a set of inserts from which the user can select one of the inserts to mount to the ice cube tray.

8. The automatic ice maker according to claim 7, wherein each insert has a set of ice cube recesses and the selection or shape of ice cube recesses is different for each set.

9. The automatic ice maker according to claim 6, wherein the insert comprises a composite structure of a flexible base and a low-friction coating.

10. The automatic ice maker according to claim 9, wherein the flexible base is made of metal.

11. The automatic ice maker according to claim 10, wherein the metal is electrically conductive and has sufficient resistance such that when a current is passed through the insert it will heat an amount sufficient to release an ice cube contained within an ice cube recess when the tray is in the harvest position.

12. The automatic ice maker according to claim 9, wherein the flexible base is made of plastic.

13. The automatic ice maker according to claim 12, wherein the plastic is one of polyurethane and silicone.

14. The automatic ice maker according to claim 9, wherein the low friction coating is one of flouropolymer, teflon, and parylenes.

15. The automatic ice maker according to claim 9, wherein the insert comprises a peripheral rim that bounds a volume at least equal to twice the sum of the volume of the ice cube recesses to retain a double fill of the ice cube tray.

16. The automatic ice maker according to claim 1, wherein the harvest mechanism comprises a harvest bar that is located to contact and flex the flexible portion of each ice cube recess when the tray is in the harvest position to aid in removing the ice cubes from the tray.

17. An automatic ice maker for a household freezer, comprising:

a housing for mounting to the interior of a household freezer;

a composite ice cube tray having multiple ice cube recesses having open tops and closed bottoms and comprising a resilient base and a low friction coating applied to the base, with the low friction coating forming the upper surface of the ice cube recesses; and a harvest mechanism moveably supporting the composite ice cube tray for movement between a fill position where liquid can be introduced into the ice cube recesses to make ice cubes and a harvest position where the closed bottoms are deformed to aid in removal of ice cubes in the ice cube recesses.

18. The automatic ice maker according to claim 17, wherein the resilient base is made of one of metal and plastic.

19. The automatic ice maker according to claim 18, wherein the base is made of metal.

20. The automatic ice maker according to claim 19, wherein the metal is electrically conductive and has sufficient resistance such that when a current is passed through the insert it will heat an amount sufficient to release an ice cube contained within an ice cube recess when the tray is in the harvest position.

21. The automatic ice maker according to claim 18, wherein the plastic is one of polyurethane and silicone.

22. The automatic ice maker according to claim 18, wherein the low friction coating is one of flouropolymer, teflon, and parylenes.

23. The automatic ice maker according to claim 22, wherein the ice cube tray is elongated and terminates in opposite ends that are rotatably attached to the housing to define a longitudinal rotational axis about which the ice cube tray is rotated to move the ice cube tray from the fill to the harvest position.

24. The automatic ice maker according to claim 23, wherein the harvest mechanism comprises a reversible electric motor for rotating the ice cube tray between the fill and harvest positions.

25. The automatic ice maker according to claim 24, wherein the harvest mechanism comprises a rotation stop that prevents the ice cube tray from rotating beyond the harvest position.

26. The automatic ice maker according to claim 25, wherein the reversible electric motor is a self-reversing electric motor that automatically reverses direction to return the ice cube tray to the fill position in response to the self-reversing electric motor stalling when the rotation of the ice cube tray is stopped by the rotation stop.

27. The automatic ice maker according to claim 26, wherein the composite ice cube tray comprises a peripheral rim that bounds a volume at least equal to twice the sum of the volume of the ice cube recesses to retain a double fill of the ice cube tray.

* * * * *